United States Patent [19]

Willim

[11] Patent Number: 4,648,439

[45] Date of Patent: Mar. 10, 1987

[54] METHOD FOR THE CONTINUOUS CASTING OF METAL BETWEEN TWO AXIALLY PARALLEL COOLED CYLINDERS

[75] Inventor: Fritz Willim, Birmensdorf, Switzerland

[73] Assignee: Concast Service Union AG, Zürich, Switzerland

[21] Appl. No.: 704,022

[22] Filed: Feb. 21, 1985

[30] Foreign Application Priority Data

Mar. 1, 1984 [CH] Switzerland ..... 998/84

[51] Int. Cl.[4] ..... B22D 11/06

[52] U.S. Cl. ..... 164/480; 164/428

[58] Field of Search ..... 164/427, 428, 429, 430, 164/431, 432, 433, 434, 479, 480, 481, 482, 413, 454

[56] References Cited

U.S. PATENT DOCUMENTS 3,730,254 5/1973 Namy ..... 164/428

4,274,471 6/1981 Minoura et al. ..... 164/428

*Primary Examiner*—Nicholas P. Godici

*Assistant Examiner*—Richard K. Seidel

*Attorney, Agent, or Firm*—Werner W. Kleeman

[57] ABSTRACT

A method and apparatus for the continuous casting of metal strips, bands or thin slabs between two axially parallel cooled drums or cylindrical rolls. The liquid metal is introduced into a hollow mold chamber and the partially solidified cast strand is held against the outer surface of one of the rolls after passage through a gap at least until its complete solidification. In order to attain a higher casting capacity combined with simple and reliable equipment, it is proposed to select, in relation to predetermined a cooling capacity, a relationship between the thickness of the band or the like and the casting speed such that the liquid core of the band is supported against the outer surface of the one roll over at least 90°, preferably over 180° to 210°.

9 Claims, 3 Drawing Figures

FIG. 2
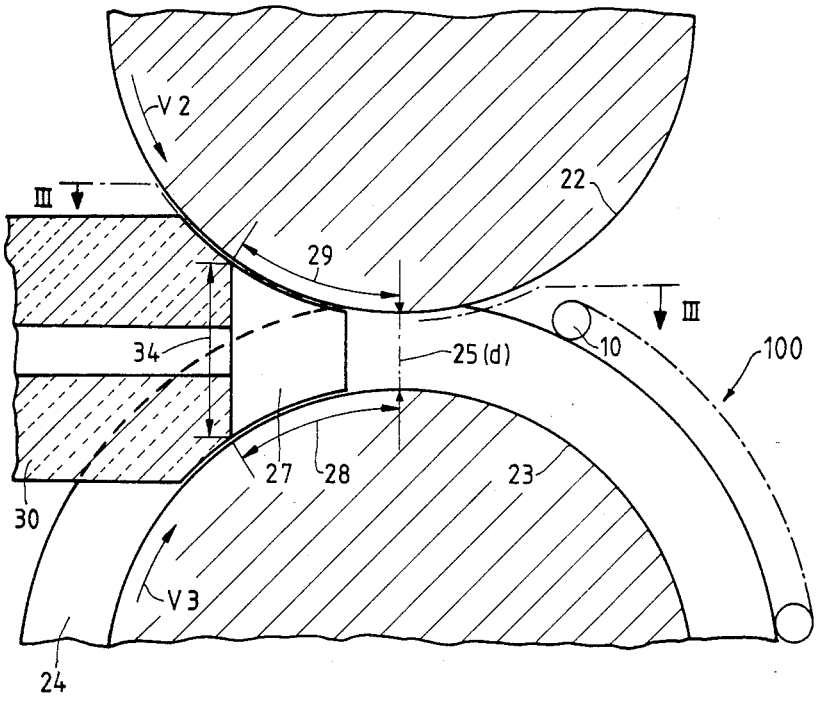
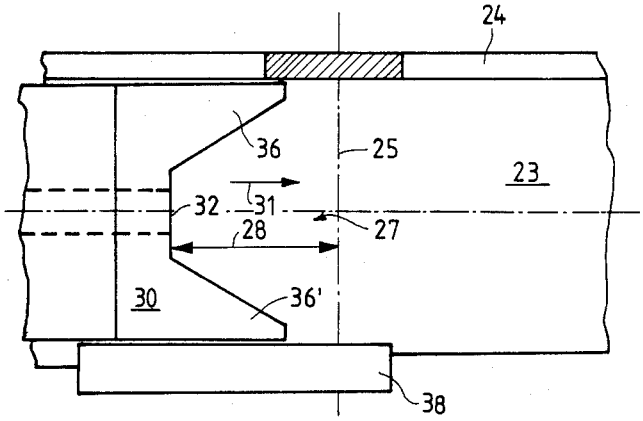
FIG. 3

METHOD FOR THE CONTINUOUS CASTING OF METAL BETWEEN TWO AXIALLY PARALLEL COOLED CYLINDERS

BACKGROUND OF THE INVENTION

The present invention broadly relates to continuous casting, and more specifically, pertains to a new and improved method and apparatus for the continuous casting of metal between two axially parallel cooled drums or cylindrical rolls.

Generally speaking, the method of the present invention relates to the continuous casting of metals, especially of steel strands in the form of a band or thin slabs, between two axially parallel cooled drums or cylindrical rolls whose mutually confronting outer surfaces are moved in the direction of feed of molten metal at substantially the withdrawal or extraction speed of the strand being cast. The liquid metal is introduced into a hollow mold chamber delimited by the two drums or cylindrical rolls and the cast band or slab is held against the outer surface of one of the drums or cylindrical rolls after passing the narrowest spacing or gap of the drums or cylindrical rolls.

In other words, the method of the present invention comprises the steps of feeding molten metal into a hollow mold chamber delimited by two axially parallel cooled rolls, moving mutally confronting outer surfaces of the two axially parallel cooled rolls essentially uniformly in the direction of metal feed at substantially the speed of withdrawal or extraction of the strand being cast and restraining the cast strand against the outer surface of one roll of the two axially parallel cooled rolls subsequent to passage through a location of closest roll spacing.

The apparatus of the present invention is capable of performing the method of the invention as described above. This inventive apparatus for the continuous casting of metal, especially of steel strands in the form of a band or thin slab, comprises two axially parallel cooled rolls arranged to form a gap or space therebetween, said gap having a pouring inlet side and a strand outlet side, and a molten metal feed device or apparatus. The two axially parallel cooled rolls form, conjointly with the feed apparatus, a hollow mold chamber or compartment on the pouring inlet side of the gap. The two axially parallel cooled rolls form, along an outer surface of one of the two axially parallel cooled rolls, an arcuate strand guide on the strand outlet side of the gap.

A method and apparatus for the continuous casting of metals, especially of steel bands, is known from the German patent publication No. 2,063,591, published July 15, 1971. Steel is cast or poured into a hollow mold chamber between two cooled, axially parallel drums. The mutually confronting outer surfaces of these drums move uniformly in the direction of metal feed at the withdrawal or extraction speed of the strand being cast. The cast and at least predominantly solidified band is held against the outer surface of one of the drums after passing the location of closest drum spacing. If this method is to yield a sufficient casting capacity for mass production, it can only be used for casting thin bands. For thicker bands or thin slabs of, for instance, 10 mm. or more in thickness, this method is not suitable for the casting capacity necessary for the rational mass production of steel, since it is based on the extensive to complete solidification of the cast strand at the exit from the gap. If the casting speed is increased, then the solidified strand crust or shell becomes increasingly thinner at the exit from the gap. Bulges, caused by the pressure of the still liquid core, and the ensuing metal breakouts then can not be avoided. An increased casting speed increases the frequency of malfunction in the method described to such an extent that economical production is not possible.

SUMMARY OF THE INVENTION

Therefore, with the foregoing in mind, it is a primary object of the present invention to provide a new and improved method and apparatus for the continuous casting of metals which does not exhibit the aforementioned drawbacks and shortcomings of the prior art constructions.

Another and more specific object of the present invention resides in providing a new and improved method and apparatus for the continuous casting of metals and of the previously mentioned type which can operate at considerable higher casting capacity and with simple, operationally reliable and economical equipment.

Yet a further significant object of the present invention aims at providing a new and improved construction of an apparatus for the continuous casting of metals and of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that it comprises the steps of selecting, in relation to a predetermined cooling capacity of the outer surfaces of the two axially parallel cylindrical cooled rolls within the hollow mold chamber, a relationship of cast strand thickness to casting speed such that the conditions are fulfilled that the cast strand leaves the narrowest gap between the cylindrical cooled rolls, i.e. the location of closest roll spacing, with a still considerable portion of liquid core and that fully complete solidification occurs only after attaining the region in which the cast strand has been further cooled and restrained against the one roll of the two axially parallel cooled rolls by a support corset or apron over an angle of at least 90°.

The apparatus of the present invention is manifested by the features that the arcuate strand guide is constructed as a support corset or apron for an only partially solidified cast strand and the arcuate strand guide wraps the one roll by at least 90°.

In order to be able to set such a highly productive plant into operationally reliable operation and to achieve the operational state in which only a minimal ferrostatic pressure acts upon the still thin strand crust or shell after leaving the gap, the present invention further proposes introducing the casting metal, with a superposed relationship of the two axially parallel cooled rolls, into the hollow mold chamber upwardly at an angle between 5° and 45° in relation to the horizontal and restraining the cast strand against the outer surface of the lower roll of the two rolls. The metal feed device is oriented upwardly and has a supply channel with a central axis and this central axis extends so as to substantially include an angle between 5° and 45° with the horizontal during casting operation.

A further distinguishing characteristic of the invention is that the metallostatic pressure in the hollow mold chamber and immediately after exit from the latter is additionally maintained low. For this purpose, the casting metal is introduced from a supply vessel or tundish through the metal supply or feed device flow communicatingly connected therewith into the hollow mold chamber such that the level of the bath of molten metal in the supply vessel or tundish is maintained at a height only slightly above the highest point on the inlet side of the hollow mold chamber. This prevents air from entering the hollow mold chamber during the entry of metal into the hollow mold chamber, on the one hand and, on the other hand, no unacceptable metallostatic pressure acts upon the initially unsupported upper side of the cast strand after the cast strand leaves the hollow mold chamber, i.e. the cast strand does not bulge. Nevertheless, due to the air pressure prevailing in the supply vessel or tundish, the liquid steel in the interior of the cast strand can rise to the highest point of the cast strand wrapping around the lower drum or cylindrical roll.

A uniform cooling of both crusts or shells converging in the gap can be obtained and strand flaws or casting malfunctions can be prevented by an additional distinguishing characteristic of the invention according to which, the tangential or peripheral speed of the surfaces of both drums or cylindrical rolls contacting the broad sides of the cast strand being cast is unequal and the ratio of the tangential or peripheral speed V3 of the outer surface of the wrapped drum or cylindrical roll having the radius R3, i.e. the lower roll, to the tangential or peripheral V2 of the outer surface of the non-wrapped roll, i.e. the upper roll, is governed by the equation:

$$V_2 = V_3 \cdot \frac{R_3 + d}{R_3}$$

wherein d corresponds to the spacing between the rolls at the narrowest gap.

Both an increase in casting capacity and in safety against metal breakout is attained by a sufficiently long solidifying path on the broad sides of the strand formed by the outer surfaces of the drums or cylindrical rolls. On the other hand, the strand should only solidify on the narrow sides when the hollow mold chamber delimited by the two mutually converging outer surfaces of the drums or cylindrical rolls only insignificantly narrows or converges, in approximate correspondence to thermal shrinkage. Otherwise a blockage of the strand in the hollow mold chamber or an unacceptable deformation of the strand narrow sides can arise.

Furthermore, it is more economical to construct as low in height as possible the narrow side flanks or flanges which move synchronously with one of the drums or cylindrical rolls, preferably the lower roll, and which also form a portion of the delimitation of the hollow mold chamber. It is therefore further proposed to form the hollow mold chamber, which is delimited by the feed device, by two narrrow side flanks or flanges moved synchronously with one of the drums or cylindrical rolls, by the outer surfaces of both drums or cylindrical rolls and by the plane of the gap (a hypothetical terminating plane across the gap), shorter on its narrow sides in the direction of metal feed than in the center of its broad sides by correspondingly constructing the feed device, and by constructing the short roll side flanks or flanges moving synchronously with one of the drums or cylindrical rolls only slightly higher than the height of the hollow mold chamber at its narrowest location.

As a further measure according to a further embodiment of the invention, the metal feed device can extend on its narrow sides with wedge-shaped walls so far into the hollow mold chamber that the wedge-shaped walls are covered over their entire height by the short roll side flanks or flanges moved synchronously with one of the drums or cylindrical rolls.

For relatively low casting speeds, such as may be entirely adequate for a sufficient production of slabs of medium thickness of about 40 to 60 mm, it is possible with no ensuing disadvantages to replace the short or narrow roll side flanks or flanges wandering synchronously with one of the drums or cylindrical rolls by more economical narrow side plates which are stationary in operation. Therefore, as a further distinguishing characteristic, it is proposed to form the hollow mold chamber shorter on its narrow sides in the direction of feed of metal than in the center of its broad sides and that the stationary narrow side plates cover only a portion of the narrow sides of the hollow mold chamber yet, for reasons of operational safety, nevertheless extend beyond the narrowest location of the hollow mold chamber.

In order to attain a uniformly continuous evacuation of the vessel or tundish at termination of a casting or pouring operation, it is additionally proposed to incorporate the feed device conjointly with the upper drum or cylindrical roll in a construction which is pivotable about the center point of the lower drum or cylindrical roll, preferably concentrically pivotable thereabout, and that the central axis of the supply channel of the feed device be pivotable at termination of casting from the operational position into an at least horizontal position or orientation. The casting metal contained in the supply vessel or tundish can thus be completely or largely cast into a strand.

A uniformly continuous tundish emptying can, however, also be attained according to a further advantageous embodiment in which the casting metal is pressed or forced through the supply channel of the feed device by providing a uniformly continuously adjustable gas pressure in the tundish. The tundish then must be provided with a gas-tight cover and the interior space of the tundish must be connected to a source of gas pressure having a regulatable pressure.

It is additionally proposed, as an alternative to the uniformly continuous emptying of the tundish, to arrange an electromagnetic pump in the supply channel of this feed device or apparatus.

BRIEF DESCRIPTION OF THE DRAWINGS

The invention will be better understood and objects other than those set forth above, will become apparent when consideration is given to the following detailed description thereof. Such description makes reference to the annexed drawings, wherein:

FIG. 2 schematically shows a vertical cross-section through the hollow mold chamber or compartment of a further embodiment; and FIG. 3 schematically shows a cross-section taken along the line III—III of FIG. 2.

DETAILED DESCRIPTION OF THE PREFERRED EMBODIMENTS

Figure 1:
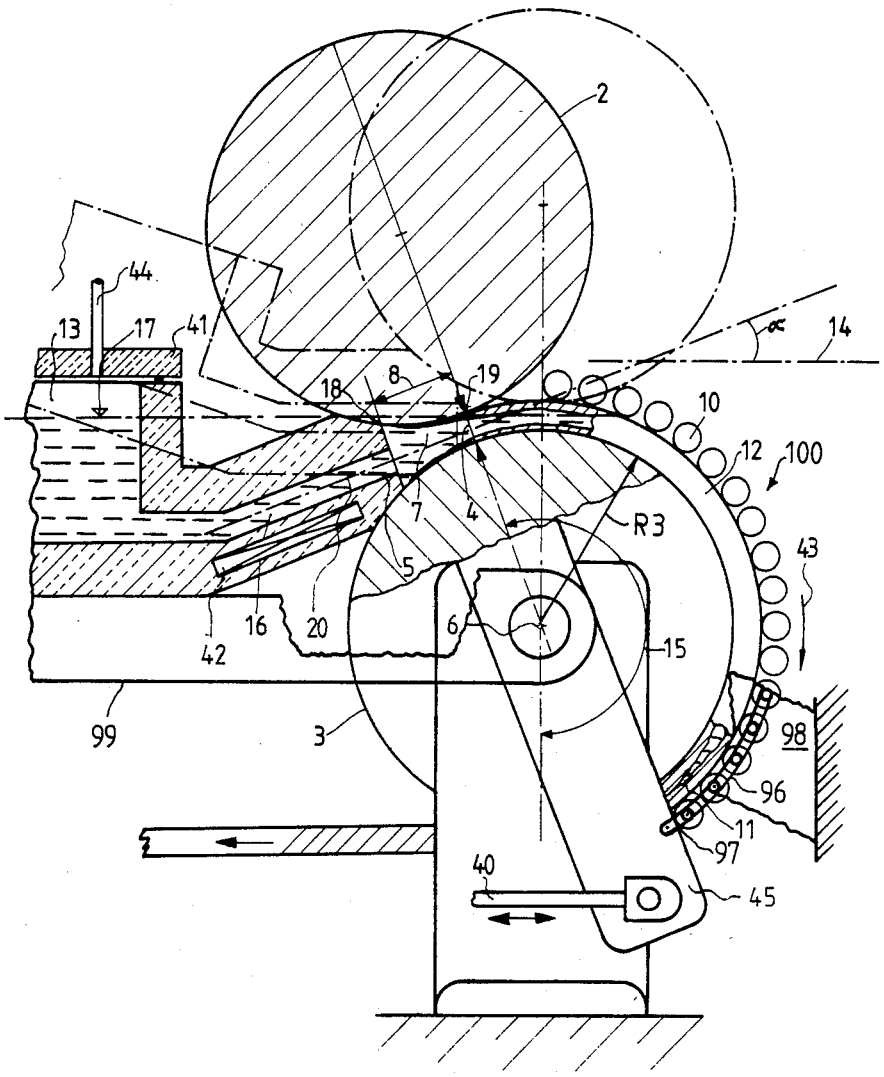
FIG. 1 schematically shows a vertical cross-section through a casting apparatus according to the invention.

Describing now the drawings, it is to be understood that to simplify the showing thereof only enough of the structure of the apparatus for the continuous casting of metals has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise an upper cooling drum or cylindrical roll 2 and a lower cooling drum or cylindrical roll 3 both arranged to be mutually axially parallel. The outer surfaces of the drums or cylindrical rolls 2 and 3 comprise, in conventional manner, a metal of high thermal conductivity, such as copper or the like, and are appropriately water-cooled.

Between a feed device or apparatus 5 and a narrowest gap or space 4 between the drums or cylindrical rolls 2 and 3, there is present on the inlet casting side of the gap 4 a hollow mold chamber or compartment 7 having a length 8. On a strand outlet side of the gap 4, the outer surface of the lower drum or cylindrical roll 3 forms an arcuate strand guide which, conjointly with rollers 10, constitutes a support corset or apron 100 for a cast strand, here shown as a cast band 12. This cast band 12 contains a liquid core 11 over a wrapping angle 15 of for instance, 180° to 210° of the circumference or periphery of the lower drum or cylindrical roll 3. This wrapping angle 15 could also be selected smaller, for instance between 90° and 100°.

Both drums or cylindrical rolls 2 and 3 are arranged in superposed relationship. The feed device 5 is flow communicatingly connected with a supply vessel or tundish 13 by a supply channel 16, and may include an angle $\alpha$ with a horizontal 14 of from 5° to 45°, preferably from 15° to 30°. The casting metal flows from the tundish 13 through the supply channel 16 opening into the feed device 5 into the hollow mold chamber 7. A level 17 of the bath of molten metal in the tundish or supply vessel 13 is maintained at a height corresponding to at least that of the point 18 in the hollow mold chamber 7 during casting.

In FIG. 1, the casting apparatus is shown in chain-dotted line in a pivoted position 19 for emptying or evacuating the tundish 13. By means of a piston rod 40 of a not particularly shown, conventional piston-and-cylinder unit, which may be articulated to a partially represented support 45 for the upper drum or cylindrical roll 2, the support 45 conjointly with the upper drum or cylindrical roll 2 is pivoted about a central axis or shaft 6 of the lower or cylindrical roll 3 conjointly with the feed device 5. A central axis 20 of the supply channel 16 is thereby brought into an approximately horizonal position in order to be able to empty the casting metal in the tundish 13 at termination of a casting or pouring operation. All or a portion of the rollers 10 of the support corset or apron 100 can be shifted in the direction of an arrow 43 during the pivoting motion by an appropriate amount.

During this pivoting motion, the tundish 13 is moved into its pivoted position 19 by means of a support arm 99 which pivots conjointly with the support 45 about the pivot axis or shaft 6. The rollers 10 defining the support apron 100 are interconnected by link members 97 (only some of which are conveniently shown), and the lowermost one of which is articulated to the lower end of the support 45. When the support 45 pivots, it entrains this assemblage of rollers 10 and link members 97 with it in a clockwise direction as seen in FIG. 1. This accordingly entrains the uppermost rollers 10 out of the path of motion of the upper drum or cylindrical roll 2. In order to thusly guide the support apron 100 and to ensure that this support apron 100 exert a sufficient and everywhere essentially constant restraining force upon the cast strand wrapping the lower drum or cylindrical roll 3 and solidifying thereupon, the rollers 10 engage at their outer ends an arcuate slot or groove 96 formed in guide plates 98 provided at both sides of the lower drum or cylindrical roll 3. The ends of the rollers 10 may directly extend into this arcuate groove 96 if it has a width equal to the diameter of the rollers 10 or, alternatively, the rollers 10 may be provided with journal pins extending beyond their outer ends and engaging such arcuate slot 96, which then would have a correspondingly lesser width. It will thus be seen that the tundish 13, and with it the central axis 20 of the supply channel 16, can be pivoted into a position suitable for completely emptying the tundish 13 while an adequate support for the cast strand 12 is still provided.

If the tundish 13 is emptied or evacuated by means of gas pressure, then it is provided with a gas-tight cover 41 and a connector or line 44 is connected to a not particularly shown, conventional source of gas pressure having regulatable pressure.

Alternatively, an emptying or evacuation of the tundish 13 can be performed by an electromagnetic pump 42 as schematically shown in FIG. 1.

In FIGS. 2 and 3, a lower drum or cylindrical roll 23 is provided with synchronously moved short or narrow roll side flanks or flanges 24 which, as shown in the present example, are a few millimeters higher than a gap 25 between an upper drum or cylindrical roll 22 and the lower drum or cylindrical roll 23. A hollow mold chamber or compartment 27 is delimited by a gap 25, by the short or narrow roll side flanks or flanges 24 arranged on both sides of the lower drum or cylindrical roll 23 and moved synchronously therewith, by outer surface regions 28 and 29 of both drums or cylindrical rolls 22 and 23 and by delimiting surfaces of a feed device or apparatus 30. This hollow mold chamber 27 is shorter in the casting direction 31 on its narrow sides, i.e. along the short or narrow roll side flanks or flanges 24, than in the center 32 of the broad side of such hollow mold chamber 27. The short or narrow roll side flanks or flanges 24 moved synchronously with the lower drum or cylindrical roll 23 are lower than the greatest height of the hollow mold chamber 27. The hollow mold chamber 27 is initially closed on its narrow sides by wedge-shaped fingers or protuberances 36 and 36' extending toward the gap 25 between the drums or cylindrical rolls 22 and 23 and subsequently by the short or narrow roll side flanks or flanges 24 after the upper drum or cylindrical roll 22 penetrates between the short or narrow roll side flanks or flanges 24 over the entire width of the hollow mold chamber 27.

A stationary side wall 38 delimiting the hollow mold chamber 27 is shown in the lower half of FIG. 3 as a further embodiment instead of the short or narrow roll side flanks or flanges 24 moved conjointly with the lower drum or cylindrical roll 23 shown in the upper half of this FIG.

The method according to the invention can be employed as described in the following. The band thickness to be cast is adapted to the subsequent rolling equipment. The band width is chosen according to sales orders and the drums or cylindrical rolls 2 and 3 and the metal feed device 5 are appropriately adjusted. The melting or foundry equipment preceding the strand or continuous casting apparatus generally produces at an approximately uniform rate which, for example in the production of steel, is very high and can exceed 100 tons per hour. For a rate of production adapted to the melting or founding equipment at constant band thickness, smaller band widths must be cast more rapidly than wider band widths. However, under industrially useful conditions, even large band widths must be cast so rapidly that the cast band 12 only solidifies on the outer crusts or shells before leaving the hollow mold chamber 7 through the gap 4 and is still liquid in its core. Bulges of the solidified but still hot and therefore mechanically weak strand crust or shell can then arise when the liquid core exerts an unacceptably high pressure and the crusts or shells are not appropriately supported. It will be evident that the support must be more closely spaced—in extreme cases even continuous—the thinner and hotter the solidified crusts or shells are and the greater the pressure exerted is.

The solidification speed of a metal cannot be arbitrarily selected, but is substantially dependent upon how rapidly the quantity of heat released by the solidification and the subsequent cooling of the metal can be conducted by the strand crusts or shells to the cooling medium. The solidification speed is high at initiation of solidification in strand and block casting of metals and reduces with increasing crust or shell thickness. The crust or shell thickness thus attained can be approximately calculated according to the formula;

$$s = k\sqrt{t},$$

wherein;

s=crust or shell thickness in mm;

k=a constant substantially dependent upon the cooling intensity (for steel band approximately 15 to 27); and t=solidification time in minutes.

The casting speeds necessary for steel bands of 100 mm width but of thicknesses varying between 3 and 80 mm which are required for attaining a casting capacity of 100 tons per hour are given in Table 1 as examples.

TABLE 1

| Given: band width 1000 mm, casting capacity 100 t/h | | |
|---|---|---|
| Band thickness in mm | Weight in kg/m | Casting speed in m/min. |
| 3 | 23.4 | 71.2 |
| 5 | 39 | 42.8 |
| 10 | 78 | 21.4 |
| 20 | 156 | 10.7 |
| 40 | 312 | 5.3 |
| 80 | 624 | 2.7 |

The time to be expexted until complete solidification—corresponding to band thickness=2×crust or shell thickness—for the same dimensions without diminution of product quality, as well as the solidification lengths ensuing therefrom for the casting speeds according to Table 1, are presented in Table 2 with indications of the k-values employed.

TABLE 2

| Band thickness | k-value | Solidification time in min. | Solidification length in meters |
|---|---|---|---|
| 3 | 16 | 0.009 | 0.64 |
| 5 | 16.5 | 0.023 | 0.98 |
| 10 | 18 | 0.077 | 1.65 |
| 20 | 20 | 0.250 | 2.67 |
| 40 | 22 | 0.862 | 4.38 |
| 80 | 24 | 2.778 | 7.50 |

In order to provide industry with bands suitable for subsequent hot-rolling, yet as thin as possible, with sufficient productivity, solidification lengths are selected which, as can be seen from Table 2, are much greater than can be realistically realized within a hollow mold chamber or compartment alone. Therefore a solution is proposed which permits extracting the liquid core far beyond the narrowest gap 4 (cf. FIG. 1) or 25 (cf. FIGS. 2 and 3). For this purpose it is important that in the region immediately subsequent to the narrowest gap and in which the outer surfaces of the two drums or cylindrical rolls progressively diverge from one another, no unacceptably high pressure be exerted by the liquid core upon the there unsupported upper crust or shell. If the cast band is subsequently guided arcuately downward, then the naturally increasing pressure of the liquid core can be compensated by a support corset or apron 100 partially surrounding the lower drum or cylindrical roll 3 at a uniform spacing thereto corresponding to the narrowest gap 4. Thus the final point of core solidification may lie at any arbitrary location before the lower end of the support corset or apron 100, which provides the desired degree of operational flexibility.

With such guidance of the band, the tangential or circumferencial speed is greater at the outer arc of the band than at the inner arc. In order to avoid that the still weak and very hot crust or shell of the exterior side of the band be stretched when leaving the hollow mold chamber 7 from its narrowest gap 4 or be drawn or stretched along the drum or cylindrical roll 2 in the region 29, it is advantageous for the tangential or circumferential speed V2 of the upper drum or cylindrical roll 2 to be greater than the tangential or circumferential speed V3 of the lower drum or cylindrical roll 3 in correspondence with the formula;

$$V_2 = V_3 \cdot \frac{R_3 + d}{R_3}$$

wherein R3 is the radius of the drum or cylindrical roll 3; and d is the gap width 4 shown in FIG. 1 or 25 shown in FIG. 2.

The duration of contact of the upper cylindrical roll 2 or 22 with the strand being cast in dependence of the casting speed results from the lengths of the hollow mold chamber or compartment 7 or 27 designated with the reference numerals 8 in FIG. 1 and 28 in FIG. 2. These lengths 8 and 28 are determinant for the solidification of a sufficiently strong strand crust or shell. The hollow mold chamber length 8, respectively 28,29, is selected according to a further embodiment of the invention in relation to the casting speed and the roll diameter such that an arc of at least 20° of the roll periphery is included. With an appropriate dimensioning of the hollow mold chamber and of the roll diameter, the metal feed device also can be so dimensioned that a solidification or freezing of steel at initiation of casting is prevented and the steel can be fed to the hollow mold chamber at low speed and with minimal turbulence.

While there are shown and described present preferred embodiments of the invention, it is to be distinctly understood that the invention is not limited thereto, but may be otherwise variously embodied and practiced within the scope of the following claims.

Accordingly, what I claim is:

1. A method of continuously casting metal strands, especially steel in the form of a band or thin slab, between two axially parallel cooled rolls each having a cylindrical surface of substantially the same diameter, comprising the steps of:

feeding molten metal into a hollow mold chamber delimited by the two axially parallel cooled rolls;

moving said cylindrical surfaces as mutually confronting outer surfaces of the two axially parallel cooled rolls essentially uniformly in the direction of metal feed substantially at the speed of extraction of the strand being cast such that both of said two axially parallel cooled rolls are in contact with the strand being cast along the entire length of said hollow mold chamber;

restraining the cast strand aginst the outer surface of one roll of the two axially parallel cooled rolls subsequent to passage through a location of closest roll spacing;

selecting, in relation to a predetermined cooling capacity of the outer surfaces of the cooling rolls located within said hollow mold chamber, a ratio of strand thickness to casting speed such that there are fulfilled the condition that the strand leaves said location of closes roll spacing defining the narrowest gap between the cooled rolls with a still considerable portion of liquid core and that fully complete solidification occurs only after attaining the region in which the strand has been further cooled and restrained against said one roll of the two axially parallel cooled rolls by a support apron over an angle of at least 90°;

maintaining the tangential speeds of the outer surfaces of both of said two axially parallel cooled rolls in contact with broad sides of the strand being cast to be mutually different from one another;

said one roll of said two axially parallel cooled rolls having a predetermined radius;

a relationship of a first tangential speed of said tangential speeds that is associated with said one roll of said two axially parallel cooled rolls to a second tangential speed of said tangential speeds that is associated with the remaining roll of said two axially parallel cooled rolls being;

$$V_2 = V_3 \cdot \frac{R_3 + d}{R_3}$$

wherein:

$V_2$ is said second tangential speed;

$V_3$ is said first tangential speed;

$R_3$ is said predetermined radius of said one roll; and d is the spacing between said two axially parallel cooled rolls at said location of closest roll spacing.

2. The method as defined in claim 1, wherein: said angle of at least 90° lies substantially between 180° and 210°.

3. The method as defined in claim 1, wherein:

in a superposed relationship of the two axially parallel cooled rolls, the casting metal is introduced into said hollow mold chamber upwardly at an angle between 5° and 45° in relation to the horizontal.

4. The method as defined in claim 3, wherein:

said angle between 5° and 45° lies substantially between 15° and 30°.

5. The method as defined in claim 3, wherein:

a said step of feeding molten metal entails feeding the molten metal from a storage vessel through a feed device flow communicatingly connected with said storage vessel into said hollow mold chamber such that a surface level of a bath of the molten metal in said storage vessel is maintained only slightly above a highest point of entry of the molten metal into said hollow mold chamber.

6. The method as defined in claim 1, wherein:

said step of restraining the strand against said outer surface of said one of the two axially parallel cooled rolls entails restraining the strand against an outer surface of a lower roll of said two axially parallel cooled rolls.

7. A method of continuously casting metal strands, especially steel in the form of a band or thin slab, between two axially parallel cooled rolls each having a cylindrical surface of substantially the same diameter, comprising the steps of:

feeding molten metal into a hollow chamber delimited by the two axially parallel cooled rolls;

moving said cylindrical surfaces as mutually confronting outer surfaces of the two axially parallel cooled rolls essentially uniformly in the direction of metal feed substantially at the speed of extraction of the strand being cast such that both of said two axially parallel cooled rolls are in contact with the strand being cast along the entire length of said hollow mold chamber;

restraining the cast strand against the outer surface of one roll of the two axially parallel cooled rolls subsequent to passage through a location of closest roll spacing;

selecting, in relation to a predetermined cooling capacity of the outer surfaces of the cooling rolls located within said hollow mold chamber, a ratio of strand thickness to casting speed such that there are fulfilled the conditions that the strand leaves said location of closed roll spacing defining the narrowest gap between the cooled rolls with a still considerable portion of liquid core and that fully complete solidification occurs only after attaining the region in which the strand has been further cooled and restrained against said one roll of the two axially parallel cooled rolls by a support apron over an angle of at least 90°;

in a superposed relationship of the two axially parallel cooled rolls, the casting metal is introduced into said hollow mold chamber upwardly at an angle between 5° and 45° in relation to the horizontal;

said step of feeding molten metal entails feeding the molten metal from a storage vessel through a feed device flow communicatingly connected with said storage vessel into said hollow mold chamber such that a surface level of a bath of the molten metal in said storage vessel is maintained only slightly above a highest point of entry of the molten metal into said hollow mold chamber; and pivoting said feed device conjointly with said support apron and an upper roll of said two axially parallel cooled rolls about an axis of a lower roll of said two axially parallel cooled rolls at termination of casting such that said angle is reduced for fully discharging said storage vessel and said feed device of said molten metal.

8. A method of operating a continuous casting apparatus having a mold chamber defined between the cylindrical outer surfaces of two axially parallel rolls of substantially equal diameter, comprising the steps of:

maintaining a predetermined level of molten metal in a storage vessel during casting;

introducing said molten metal continuously from said storage vessel through a feed device into said mold chamber;

rotating a lower roll of said two axially parallel rolls with a first peripheral speed;

rotating an upper roll of said two axially parallel rolls with a second peripheral speed;

cooling said lower roll in relation to said first peripheral speed such that said molten metal in said mold chamber solidifies to form on said outer surface of said lower roll a first crust of a strand being cast;

cooling said upper roll in relation to said second peripheral speed such that said molten metal in said mold chamber solidifies to form in temporary contact with said outer surface of said upper roll a second crust of said strand being cast;

said first peripheral speed being substantially equal to a desired speed of casting said strand and a surface speed of said first crust;

said second peripheral speed being substantially equal to a surface speed of said second crust such that said second curst is prevented from stretching and cracking;

restraining by means of a support apron comprising support rollers said strand being cast to follow said outer surface of said lower roll such that said second crust separates from said outer surface of said upper roll and follows said first crust on said outer surface of said lower roll while entraining a liquid core of molten metal between said first crust and said second crust;

supporting said strand being cast at said second crust by means of said support rollers such that bulging of said second crust and break-out of said liquid core are prevented;

further cooling said lower roll such that said molten metal in said liquid core continues to solidify;

entraining said strand being cast around said lower roll through an angle of at least 90° until said liquid core has substantially solidified;

continuously separating said strand being cast from said lower roll and continuously extracting said separated strand from the continuous casting apparatus for further processing; and upon desired interruption of continuously casting said strand pivoting said upper roll, said support apron, said feed device and said storage vessel conjointly about an axis of said lower roll such that said storage vessel is fully discharged.

9. A method of operating a continuous casting apparatus having a mold chamber defined between the cylindrical outer surfaces of two axially parallel rolls of substantially equal diameter, comprising the steps of:

maintaining a predetermined level of molten metal in a storage vessel during casting;

introducing said molten metal continuously from said storage vessel through a feed device into said mold chamber;

rotating a lower roll of said two axially parallel rolls wifh a first peripheral speed;

rotating an upper roll of said two axially parallel rolls with a second peripheral speed;

cooling said lower roll in relation to said first peripheral speed such that said molten metal in said mold chamber solidifies to form on said outer surface of said lower roll a first crust of a strand being cast;

cooling said upper roll in relation to said second peripheral speed such that said molten metal in said mold chamber solidifies to form in temporary contact with said outer surface of said upper roll a second crust of said strand being cast;

said first peripheral speed being substantially equal to a desired speed of casting said strand and a surface speed of said first crust;

said second peripheral speed being substantially equal to a surface speed of said second crust such that said second crust is prevented from stretching and cracking;

restraining by means of a support apron comprising support rollers said strand being cast to follow said outer surface of said lower roll such that said second crust separates from said outer surface of said upper roll and follows said first crust on said outer surface of said lower roll while entraining a liquid core of molten metal between said first crust and said second crust;

supporting said strand being cast at said second crust by means of said support rollers such that bulging of said second crust and break-out of said liquid core are prevented;

further cooling said lower roll such that said molten metal in said liquid core continues to solidify;

entraining said strand being cast around said lower roll through an angle of at least 90° until said liquid core has substantially solidified; and continuously separating said strand being cast from said lower roll and continuously extracting said separated strand from the continuous casting apparatus for further processing;

maintaining the tangential speeds of outer surfaces of both of said two axially parallel cooled rolls in contact with broad sides of the strand being cast to be mutually different from one another;

said one roll of said two axially parallel cooled rolls having a predetermined radius;

a relationship of a first tangential speed of said tangential speeds that is associated with said one roll of said two axially parallel cooled rolls to a second tangential speed of said tangential speeds that is associated with the remaining roll of said two axially parallel cooled rolls being;

$$V_2 = V_3 \cdot \frac{R_3 + d}{R_3}$$

wherein:

$V_2$ is said second trangential speed;

$V_3$ is said first tangential speed;

$R_3$ is said predetermned radius of said one roll; and d is the spacing between said two axially parallel cooled rolls at said location of closest roll spacing.

* * * * *